US005623332A

United States Patent [19]

Kawaguchi

[11] Patent Number: 5,623,332

[45] Date of Patent: Apr. 22, 1997

[54] APPARATUS AND METHOD FOR FORMING AN IMAGE UTILIZING A BIAS VOLTAGE APPLIED TO A PRE-DETERMINED AREA OF A PAPER GUIDE

[75] Inventor: Taiichi Kawaguchi, Tokyo, Japan

[73] Assignee: Kabushiki Kaisha Toshiba, Kawasaki, Japan

[21] Appl. No.: 329,428

[22] Filed: Oct. 24, 1994

[30] Foreign Application Priority Data

Dec. 20, 1993 [JP] Japan ..... 5-319805

[51] Int. Cl.[6] ..... G03G 21/00; G03G 15/14

[52] U.S. Cl. ..... 399/388; 399/314; 399/66

[58] Field of Search ..... 355/308, 309, 355/311, 274, 271, 273; 271/144, 164, 171, 223, 213

[56] References Cited

U.S. PATENT DOCUMENTS

| | | | |
|---|---|---|---|
| 4,471,234 | 9/1984 | Horiuchi | 355/311 X |
| 5,110,106 | 5/1992 | Matsumura et al. | 271/171 X |
| 5,337,128 | 8/1994 | Hashizume et al. | 355/271 |

FOREIGN PATENT DOCUMENTS 61-32667 7/1986 Japan .

*Primary Examiner*—Shuk Yin Lee
*Attorney, Agent, or Firm*—Foley & Lardner

[57] ABSTRACT

A transport device for alternatively transporting a first sheet-like material which is a first size and a second sheet-like material which is second size different than the first size, to pass a charging portion which applies an electric charge of a predetermined polarity, includes a base member made from an insulating material, a first conductive guide member arranged on the base member along a transport direction of the sheet-like material, and a second conductive guide member arranged on the base member along the transport direction and apart from the first conductive guide. The first conductive guide member guides both the first sheet-like material and the second sheet-like material, and the second conductive guide member guides the second sheet-like material. Also, the transport device includes a voltage source coupled to the first conductive guide member and the second conductive guide member, a first switch arranged between the voltage source and the first conductive guide member, and a second switch arranged between the voltage source and the second conductive guide member. A polarity of voltage applied by the voltage source is approximately the same as the predetermined polarity. Furthermore, the transport device includes a control device for turning on the first switch when the first sheet-like material is guided, and for turning on the first switches and the second switch when the second sheet-like material is guided.

13 Claims, 10 Drawing Sheets

APPARATUS AND METHOD FOR FORMING AN IMAGE UTILIZING A BIAS VOLTAGE APPLIED TO A PRE-DETERMINED AREA OF A PAPER GUIDE

BACKGROUND OF THE INVENTION

1. Field of the Invention

The present invention relates to an image-forming apparatus and, more specifically, to a guide, arranged upstream to a transfer device for electrostatically transferring an image to a sheet-like material, to which a bias voltage is applied.

2. Description of the Related Art

Many kinds of image-forming devices have an electrostatic transfer device which transfers a toner image from an image-bearing member, e.g., a photosensitive drum, to a sheet-like material, e.g., a paper sheet. In these image-forming apparatuses, a transport mechanism transports the sheet-like material to the transfer device one by one, and the sheet-like material is supported by the transport mechanism when the transfer device transfers the toner image. If the transfer mechanism which the sheet-like material contacts when the toner image is transferred, is made from an insulating material, the transfer mechanism stores an electric charge which is provided by the transfer charger or is caused by friction between the transfer mechanism and the sheet-like material when the humidity is low. Therefore, the transferred image may not be of high quality due to the influence of the stored electric charge. Also, the stored electric charge attracts toner floating in the air, and the attracted toner makes the back of the sheet-like material dirty.

On the other hand, if the transport mechanism which the sheet-like material contacts when the toner image is transferred, is made from a conductive material coupled to a ground potential, the transfer charge from the transfer device leaks to the ground potential through the sheet-like material and the transport mechanism when the humidity is high. Therefore, the transferred image may not be of high quality.

In this way, recently, an image-forming device which may form a high quality transferred image irrespective of the humidity, is requested.

As one structure which responds to this request, a transport mechanism to which a bias voltage is applied is disclosed by Japanese Patent Publication No. 61-32667.

This structure, however, has a problem. That is, toner is attracted by a non-contact portion of the transport mechanism which the sheet-like material does not contact when the sheet-like material is transported. Therefore, when a large size sheet-like material is transported after a small size sheet-like material is transported, the attracted toner makes the back of the large size sheet-like material dirty.

SUMMARY OF THE INVENTION

It is therefore an object of the present invention to provide an improved transport device for an image-forming apparatus.

It is a particular object of the present invention to provide a transport device which makes an image-forming apparatus form a high quality transferred image irrespective of the humidity, and which keeps a sheet-like material clean.

A further object of the present invention resides in the provision of an image-forming apparatus having an improved transport device.

Another object of the invention is to provide an improved image-forming method.

In accordance with one aspect of the present invention, the foregoing objects, among others, are achieved by providing a transport device for alternatively transporting a first sheet-like material which is a first size and a second sheet-like material which is second size different than the first size, to pass a charging portion which applies an electric charge of a predetermined polarity, having a base member made from an insulating material, a first conductive guide member arranged on the base member along the transport direction of the sheet-like material, and a second conductive guide member arranged on the base member along the transport direction and apart from the first conductive guide. The first conductive guide member guides both the first sheet-like material and the second sheet-like material, and the second conductive guide member guides the second sheet-like material. Also, the transport device includes a voltage source coupled to the first conductive guide member and the second conductive guide member, a first switch arranged between the voltage source and the first conductive guide member, and a second switch arranged between the voltage source and the second conductive guide member. A polarity of voltage applied by the voltage source is the same as the predetermined polarity. Furthermore, the transport device includes a control device for turning on the first switch when the first sheet-like material is guided, and for turning on the first switch and the second switch when the second sheet-like material is guided.

In accordance with another aspect of the present invention, there has been provided an image-forming apparatus for forming an image on a sheet-like material, having means for forming a toner image on an image-bearing member, means for electrostatically transferring the toner image from the image-bearing member to a sheet-like material by applying an electric charge of a predetermined polarity to the sheet-like material at a transfer region, and means for transporting the sheet-like material to the transfer region. The transporting means has a conductive guide member which contacts the sheet-like material when the transferring means transfers the toner image. The image-forming apparatus also has means for applying a bias voltage to a predetermined area of the conductive guide. A polarity of the bias voltage is the same as the predetermined polarity. The predetermined area is an area which contacts the sheet-like material when the transportation means transports the sheet-like material and corresponds to a size of the sheet-like material.

In accordance with still another aspect of the present invention, there has been provided an image-forming method for forming an image on a sheet-like material, having the steps of forming a toner image on an image-bearing member; electrostatically transferring the toner image from the image-bearing member to a sheet-like material by applying an electric charge of a predetermined polarity to the sheet-like material at a transfer region; transporting the sheet-like material to the transfer region using a conductive guide member when the transferring means transfers the toner image; and applying a bias voltage to a predetermined area of the conductive guide member. A polarity of the bias voltage is the same as the predetermined polarity. The predetermined area is an area which contacts the sheet-like material when the sheet-like material is transported and corresponds to a size of the sheet-like material.

BRIEF DESCRIPTION OF THE DRAWINGS

A more complete appreciation of the present invention and many of the attendant advantages thereof will be readily obtained as the invention becomes better understood by reference to the following detailed description, when considered in connection with the accompanying drawings, wherein.

DETAILED DESCRIPTION OF THE PREFERRED EMBODIMENTS

Figure 1:
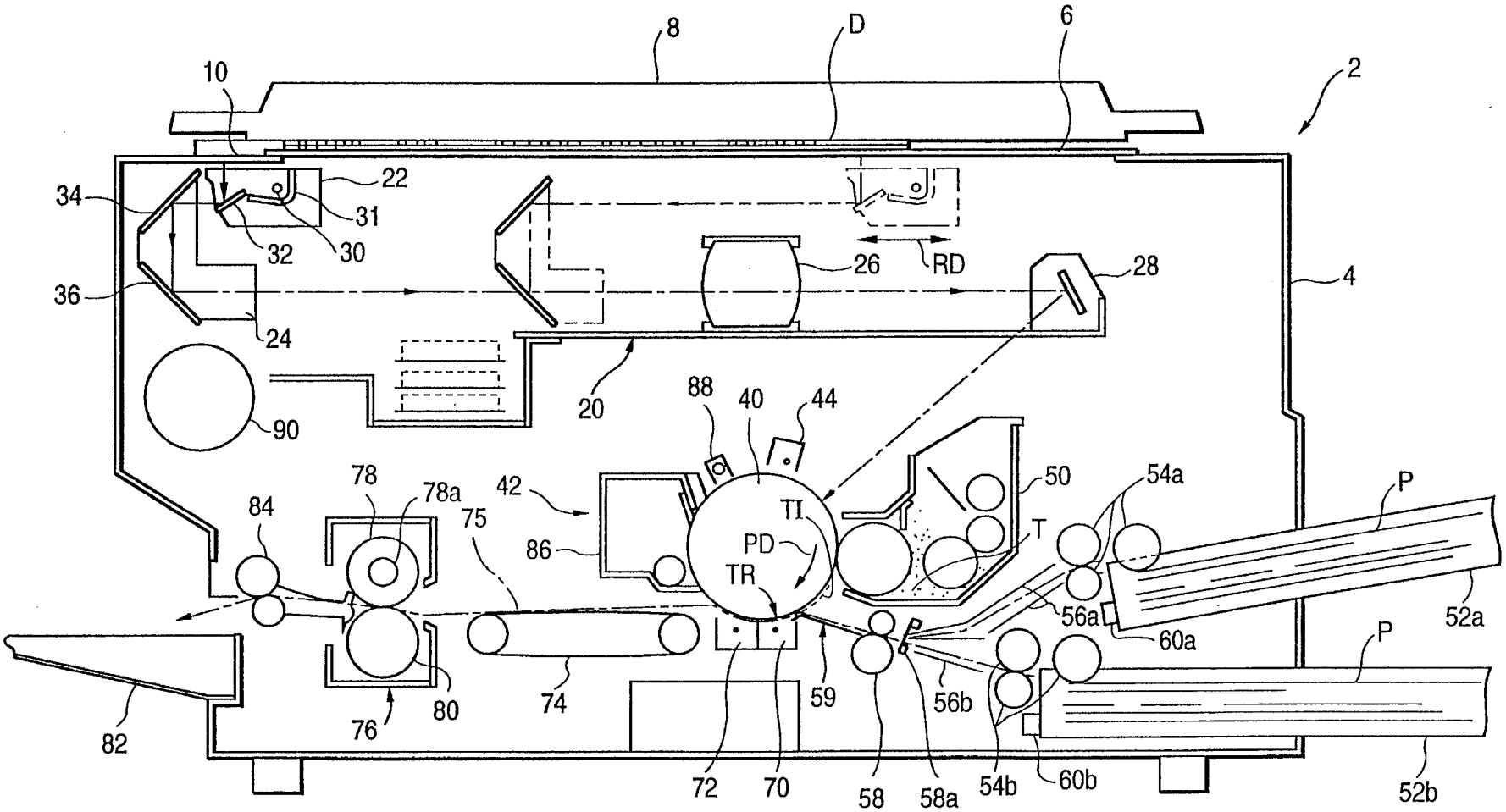
FIG. 1 is a sectional view showing the arrangement of a copying machine.

FIG. 1 shows a copying machine 2 as an image-forming apparatus according to a first embodiment of the present invention. Copying machine 2 includes a copying machine housing 4. A platen 6 which is a transparent glass is fixed on the upper surface of housing 4. A platen cover 8 is arranged to removably cover platen 6. A scale 10 for indicating a position to be placed, and positioning an original D is at one of platen 6 along the longitudinal direction thereof.

Original D placed on platen 6 is scanned for image exposure by an optical system 20. Optical system 20 includes a first carriage 22, a second carriage 24, a lens block 26 for focusing the light from original D (either unmagnified, magnified or reduced), and a mirror 28. First carriage 22 includes an exposure lamp 30, a reflector 31 for reflecting the light from exposure lamp 30 to platen 6 and a mirror 32. Second carriage 24 includes a mirror 34 and a mirror 36. When optical system 20 scans original D, original D is exposed by exposure lamp 30 while first carriage 22 and second carriage 24 reciprocate in the direction indicated by an arrow RD along the under surface of platen 6. In this case, second carriage 24 moves at a speed half that of first carriage 22 in order to maintain a fixed optical path length.

A reflected light beam from original D scanned by optical system 20 is reflected by mirror 32, mirror 34 and mirror 36, transmitted through lens block 26 and then reflected by mirror 28 to be directed on a photosensitive drum 40. Thus, an electrostatic latent image of original D is formed on the surface of photosensitive drum 40.

Photosensitive drum 40 is surrounded by an image-forming unit 42 including optical system 20. Photosensitive drum 40 is rotated by a motor (not shown) in the direction indicated by an arrow PD so that its surface is wholly charged first by a main charger 44 and the potential is preferably +700 V to +800 V. The output level of main charger 44 is about 5 KV. The image of original D is projected on the charged surface of photosensitive drum 40 by slit exposure, forming the electrostatic latent image on the surface. The exposure light quantity is preferably 20 to 50/lux. The electrostatic latent image is developed into a visible image which is a toner image T1 by a developing unit 50 using toner T. The average diameter of toner T is about 6 μm to 15 μm. Toner T is previously charged at about −10 μc/g to −40 μc/8. Paper sheets P as an image record media are delivered one by one from an upper paper cassette **52*a* or a lower paper cassette 52*b* by paper-supply rollers 54*a* or paper-supply rollers 54*b*, and guided by paper guides 56*a*, and 56*b* to an aligning roller pair 58. Paper sheet P is detected by an aligning switch 58*a* just upstream of aligning roller pair 58 in the transportation direction of paper sheet P. Then, each paper sheet P is delivered to a transfer region TR by aligning roller pair 58 while paper sheet P is guided by a guide 59**, timed to the formation of the visible image.

Paper cassette **52*a* and paper cassette 52*b* are removably attached to the lower right end portion of housing 4, and can be alternatively selected by operation on a control panel which will be described in detail later. Paper cassette 52*a* and paper cassette 52*b* are provided, respectively, with cassette size detecting switches 60*a* and 60*b*** (only one shown) which detect the selected cassette size. The detecting switches are each formed by a plurality of microswitches which are turned on or off in response to insertion of cassettes of different sizes.

Paper sheet P delivered to the transfer region TR comes into intimate contact with the surface of photosensitive drum 40, in the space between a transfer charger 170 and photosensitive drum 40. As a result, the toner image T1 on photosensitive drum 40 is transferred to paper sheet P by the agency of transfer charger 70. The output voltage of transfer charger 70 is about 5 KV. After the transfer, paper sheet P is separated from photosensitive drum 40 by a separation charger 72 and transported by a conveyor belt 74 through a sheet transport path 75. The output peak-to-peak voltage of separation charger 72 is about 4 KV. Thus, paper sheet P is delivered to a fixing unit 76 arranged at the terminal end portion of conveyor belt 74. Fixing unit 76 includes a heat roller 78 which has a heater lamp **78*a* and a pressure roller 80 which is arranged in contact with heat roller 78. As paper sheet P passes a nip portion between heat roller 78 and pressure roller 80, the transferred image is fixed on paper sheet P. After the fixation, paper sheet P is discharged into a tray 82 outside housing 4 by rotation of an exit roller pair 84**.

After the transfer, moreover, the residual toner on the surface of photosensitive drum 40 is removed by a cleaner 86. Thereafter, a residual latent image on photosensitive drum 40 is erased by a discharge lamp 88 to restore the initial state. A cooling fan 90 for preventing the temperature inside housing 4 from rising is arranged at an upper-left portion of fixing unit 76.

The construction of guide 59, transfer charger 70, and separation charger 72 will now be described in detail.

Figure 2:
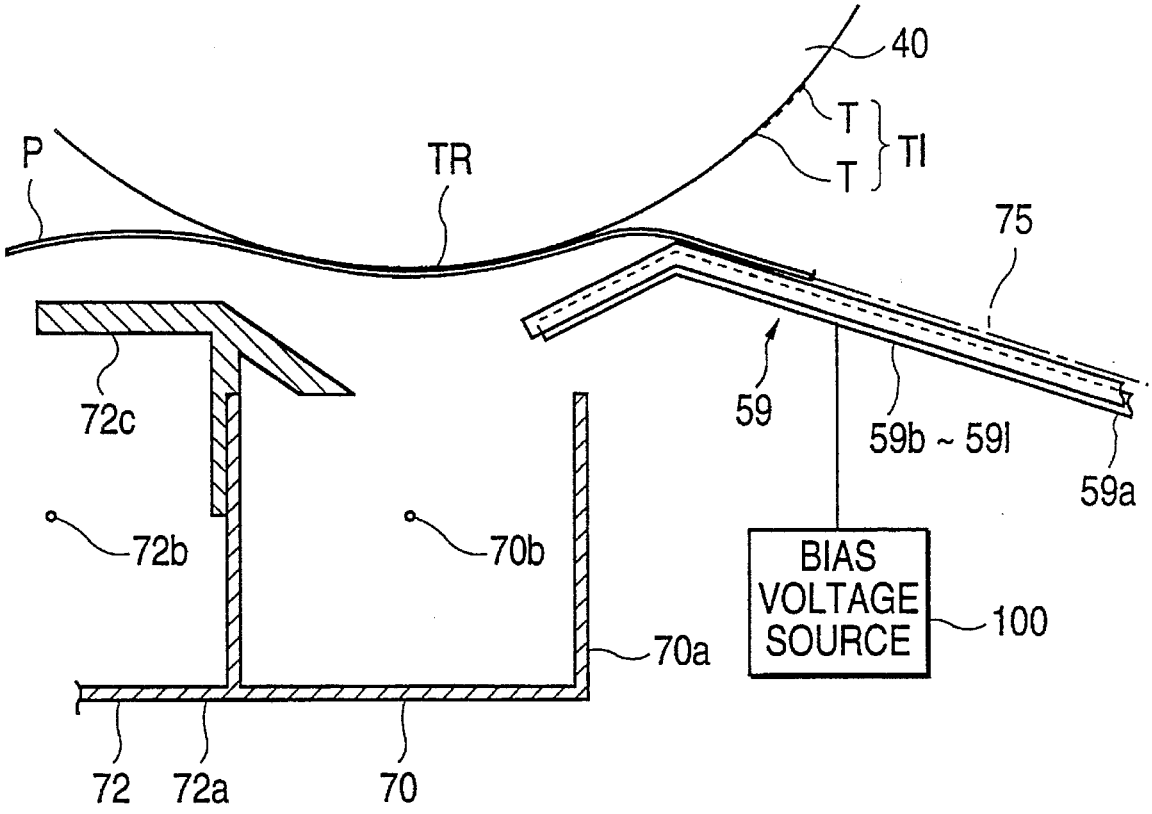
FIG. 2 is an enlarged view of a portion of the sectional view of FIG. 1.

As shown in FIG. 2, transfer charger 70 has a shield case **70*a* having an opening opposing photosensitive drum 40, and a wire 70*b* which is a corona discharging electrode, extending in shield case 70*a* to be parallel to an axis of rotation of photosensitive drum 40. Separation charger 72 has a shield case 72*a* having an opening opposing photosensitive drum 40, and a wire 72*b* which is a corona discharging electrode, extending in shield case 72*a* to be parallel to the axis of rotation of photosensitive drum 40. Shield case 72*a* is formed integrally with shield case 70*a* of transfer charger 70. A convey guide 72***c* is arranged at the opening of separation charger 72. Convey guide 72*c* guides paper sheet P toward conveyor belt 74 in order to prevent paper sheet P from entering shield case 72*a*.

An extending end of guide 59 is located above an outer side wall of shield case 70*a*. Guide 59 and convey guide 72*c* guide a paper sheet P to ensure contact by paper sheet P with the surface of photosensitive drum 40. Thus, dispersion of toner T, and blurring of toner image T1 on paper sheet P are prevented, and a high level image quality is maintained even if an operator copies a copied image repeatedly.

Figure 3:
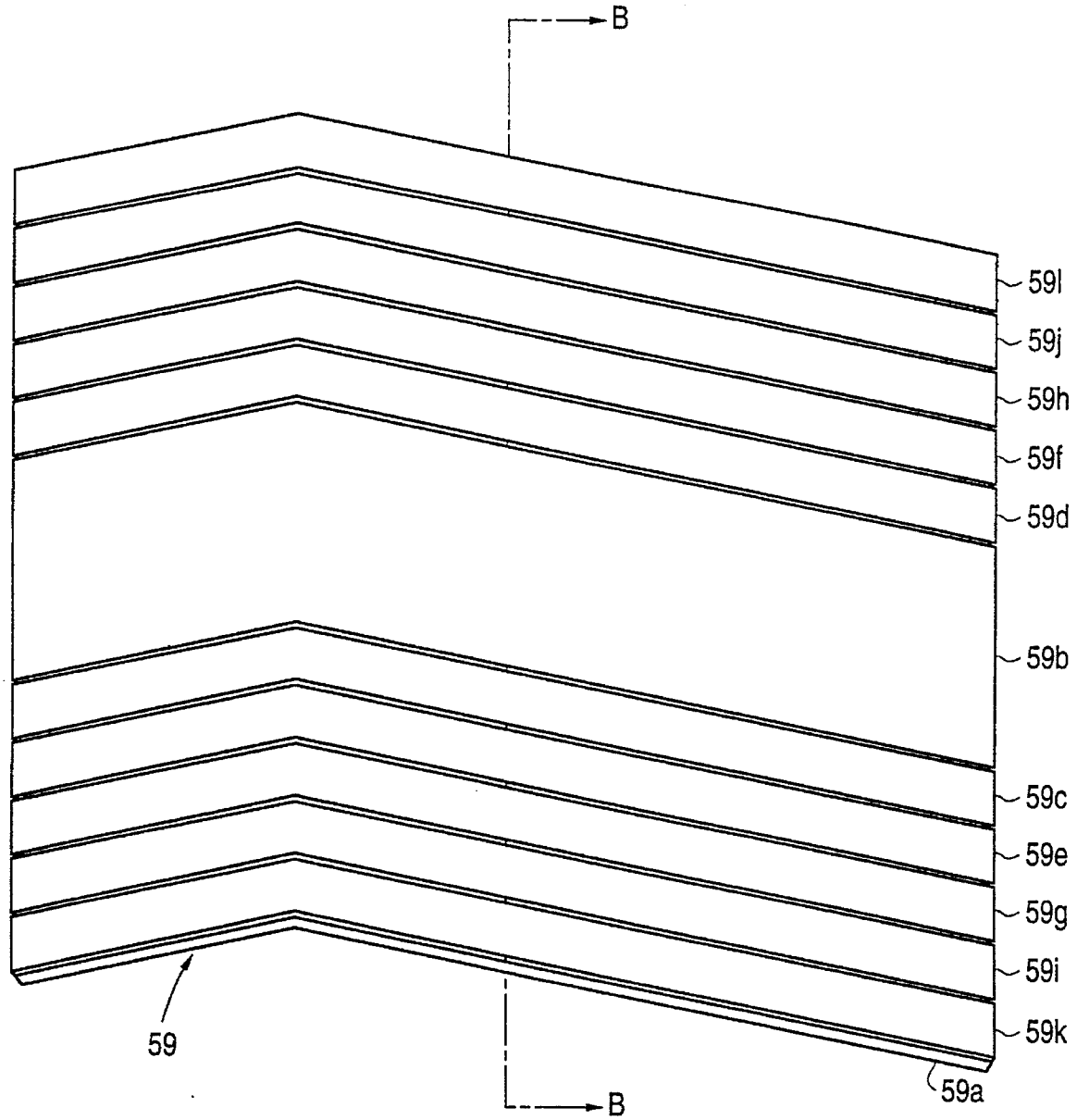
FIG. 3 is a perspective view of a guide of the copying machine.
Figure 4:
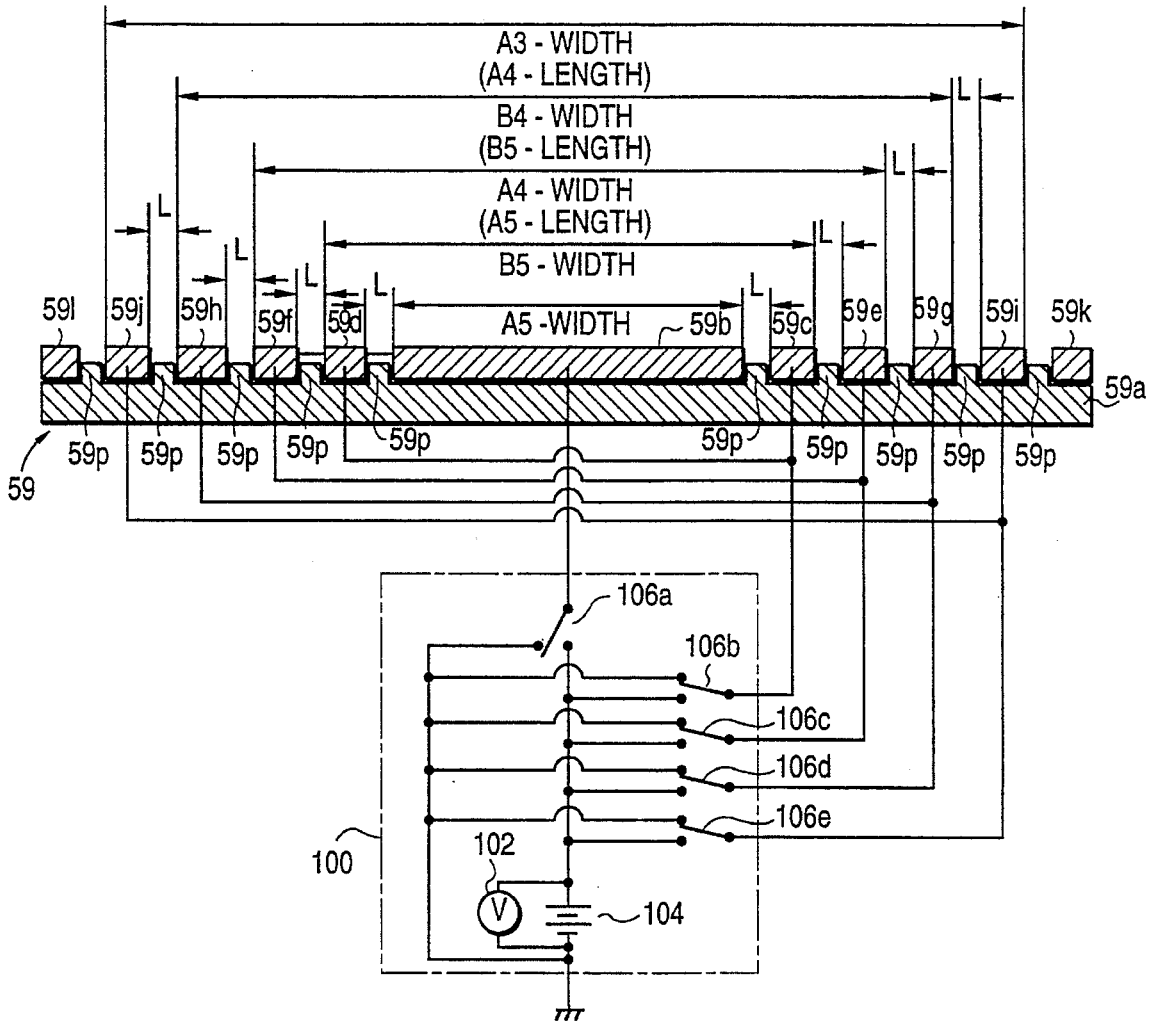
FIG. 4 is a sectional view along section line B—B in FIG. 3 showing the guide.
Figure 5:
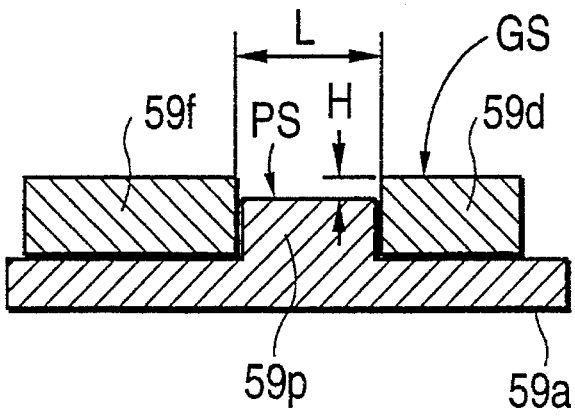
FIG. 5 is an enlarged view of a portion of the sectional view of FIG. 4.
Figure 6:
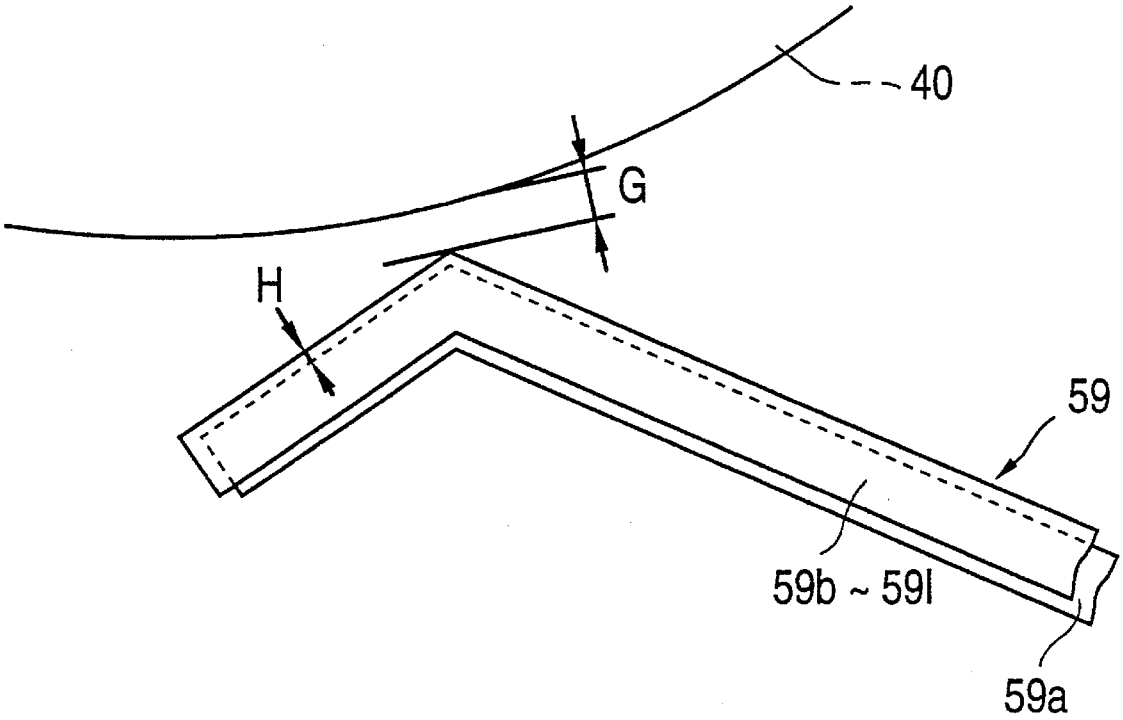
FIG. 6 is an enlarged view of a portion of the enlarged view of FIG. 2.

Guide 59 has a base member 59*a* made from an insulating material, and conductive guide members 59*b* to 59*l*. Conducting guide members 59*b* and 59*j* are coupled to a bias voltage source 100, as shown in FIGS. 3 and 4. Conductive guide members 59*b* to 59*j* are arranged on base member 59*a* and elongated along the transport direction of a paper sheet P. Also, conductive guide members 59*b* to 59*j* are formed integrally with base member 59*a*. When a paper sheet P is transported, guide 59 guides paper sheet P so that the central portion of paper sheet P corresponds to the control portion of guide 59. Conductive guide member 59*b* is arranged on the central portion of guide 59, and the width of conductive guide member 59 corresponds to the width of A5. Conductive guide members 59*c* and 59*d* are arranged on the outside of conductive guide member 59*b* so that there is a distance L. The distance between the outer edge of conductive guide member 59*c* and the outer edge of conductive guide member 59*d* corresponds to the width of B5. The distance L is preferably about 0.5 mm to 10.0 mm. If the distance L is less than 0.5 mm, the electric current may leak between the conductive guide members. On the other hand, if the distance L is more than 10.0 mm, a paper sheet P may be bent irrespective of its stiffness and paper sheet P may not contact the surface of photosensitive drum 40 surely. Therefore, the transferred image quality may not be good if the distance L is not about 0.5 mm to 10.0 mm. As shown in FIG. 5, projections 59P are formed on base member 59*a* corresponding to the space of the distance L between conductive members. A surface PS of projection 59P is H mm lower than a guide surface of the conductive guide member. The gap H is preferably about 1 mm or more and prevents projection 59P of base members 59*a* from contacting paper sheet P. Thus, this structure prevents base member 59*a* from attracting toner T because projection 59P is not triboelectrically charged, and the back of a paper sheet P does not become dirty. As shown in FIG. 6, there is a gap G between photosensitive drum 40 and guide 59. In general, the smaller the gap is, the better the transferred image is. However, if the gap G is about 2.5 mm or less, it may be easy for guide 59 to attract toner T. But, if the structure as described above is used, this problem may be solved. Therefore, the most appropriate gap G may be selected, and the attraction of toner T to guide 59 does not need to be considered.

The conductive guide members 59*e*, 59*g*, 59*i*, and 59*k* are arranged on the outside of conductive guide member so that they are spaced apart by the distance L. The conductive guide members 59*f*, 59*h*, 59*j*, and 59*l* are arranged on the outside of conductive guide member as well as conductive guide members 59*e*, 59*g*, 59*i*, and 59*k*.

The embodiment of FIGS. 2 and 4 is designed for both A and B type paper. The distance between the outer edge of conductive guide member 59*e* and the outer edge of conductive guide member 59*f* corresponds to the width of A4 (A5-length). The distance between the outer edge of conductive guide member 59*g* and the outer edge of conductive guide member 59*h* corresponds to the width of B4 (B5-length). The distance between the outer edge of conductive guide member 59*i* and the outer edge of conductive guide member 59*j* corresponds to the width of A3 (A4-length).

Bias voltage source 100 includes an oscillatory voltage source which has an AC voltage source 102 and a DC voltage source 104, and switches 106*a* to 106*e*. The oscillatory voltage source provides the conductive guide members with an oscillatory voltage source provided by superimposing AC voltage source 102 and DC voltage source 104. The peak-to-peak voltage of AC voltage source 102 is preferably about 1 KV to 2 KV, and the DC voltage of DC voltage source 104 is preferably about 1 KV to 2 KV.

Figure 7:
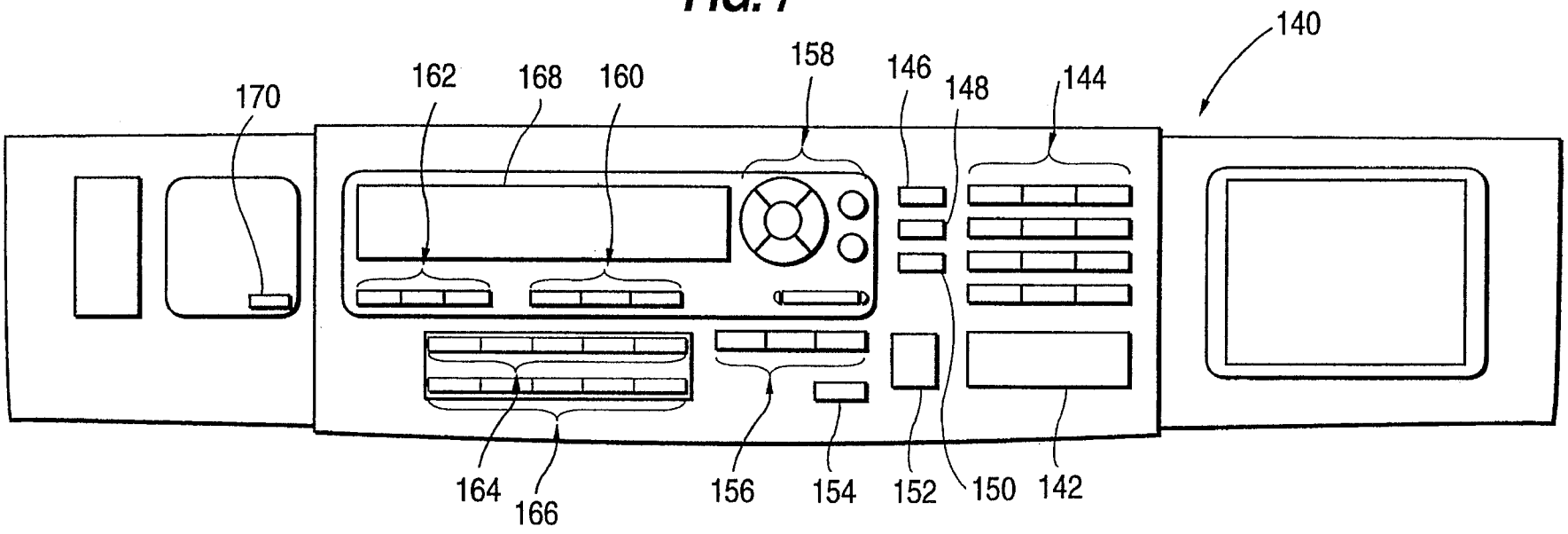
FIG. 7 is a plan view of a control panel.

Each of switches 106*a* to 106*e* alternatively connects the oscillatory voltage source and a ground potential to the corresponding conductive guide member. Conductive guide member 59*b* couples to switch 106*a*. Conductive guide members 59*c* and 59*d* couple to switch 106*b*. Conductive guide members 59*e* and 59*f* couple to switch 106*c*. Conductive guide members 59*g* and 59*h* couple to switch 106*d*. Conductive guide members 59*i* and 59*j* couple to switch 106*e*. Each of switches 106*a* to 106*e* connects the oscillatory voltage source to the corresponding conductive guide member when a paper sheet P is transported on the conductive guide member. Thus, operation of the switches 106*a* to 106*e* depends on the timing of the paper sheet transportation and the size of the paper sheet transported is set by an operator using a control panel 140 as shown in FIG. 7.

Control panel 140 is mounted on housing 4. Control panel 140 carries thereon a copy key 142 for starting the copying operation, keys 144 for setting the number of copies to be made and the like, a function clear key 146 for setting the standard status, an energy saver key 148 for going into the energy-saving mode and turning all its display lamps off, an interrupt key 150 for making a copy of a different original during a multicopy run, and a clear/stop key 152 for clearing the copy quantity entered or stopping a multicopy run. Control panel 140 has a photo key 154 on the left side of clear/stop key 152. When photo key 154 is depressed once, copying machine 2 is set in the photo mode from the normal mode.

Control panel 140 is further provided with a density setting section 156 for setting the copy density, an editing key 158 for setting the trimming mode or making mode, operation guide keys 160 for asking the appropriate operation procedure and answering the questions from copying machine 2, zoom keys 162 for adjustably setting the enlargement or reduction ratio, original size keys 164 for setting an original size, copy size keys 166 for selecting the paper sheet size to be transported. Copy size keys 166 have five keys. These five keys have one to one correspondence to an A3-length, a B4-length, an A4-width, and a B5-width. The "length" represents that the length of the paper sheet corresponds to the paper sheet transport direction. The "width" represents that the width of the paper sheet corresponds to the paper sheet transport direction. Furthermore, when an operator operates copy size keys 166, copying machine 2 sets one of paper cassettes 52*a* and 52*b* so that the paper sheet size input by copy size keys 166 corresponds to the paper sheet size detected by cassette size detecting switches 60*a* and 60*b*. In the meantime, paper cassette 52*a* or 52*b* may be exchanged for others which have other size paper sheets, by an operator.

Additionally arranged on control panel 140 are a display section 168 for indicating the operating conditions of the individual parts, and a cassette selection key 170 for alternatively selecting paper cassette 52*a* and 52*b*.

A control system for applying the bias voltage to guide 50 is described in detail below.

Figure 8:
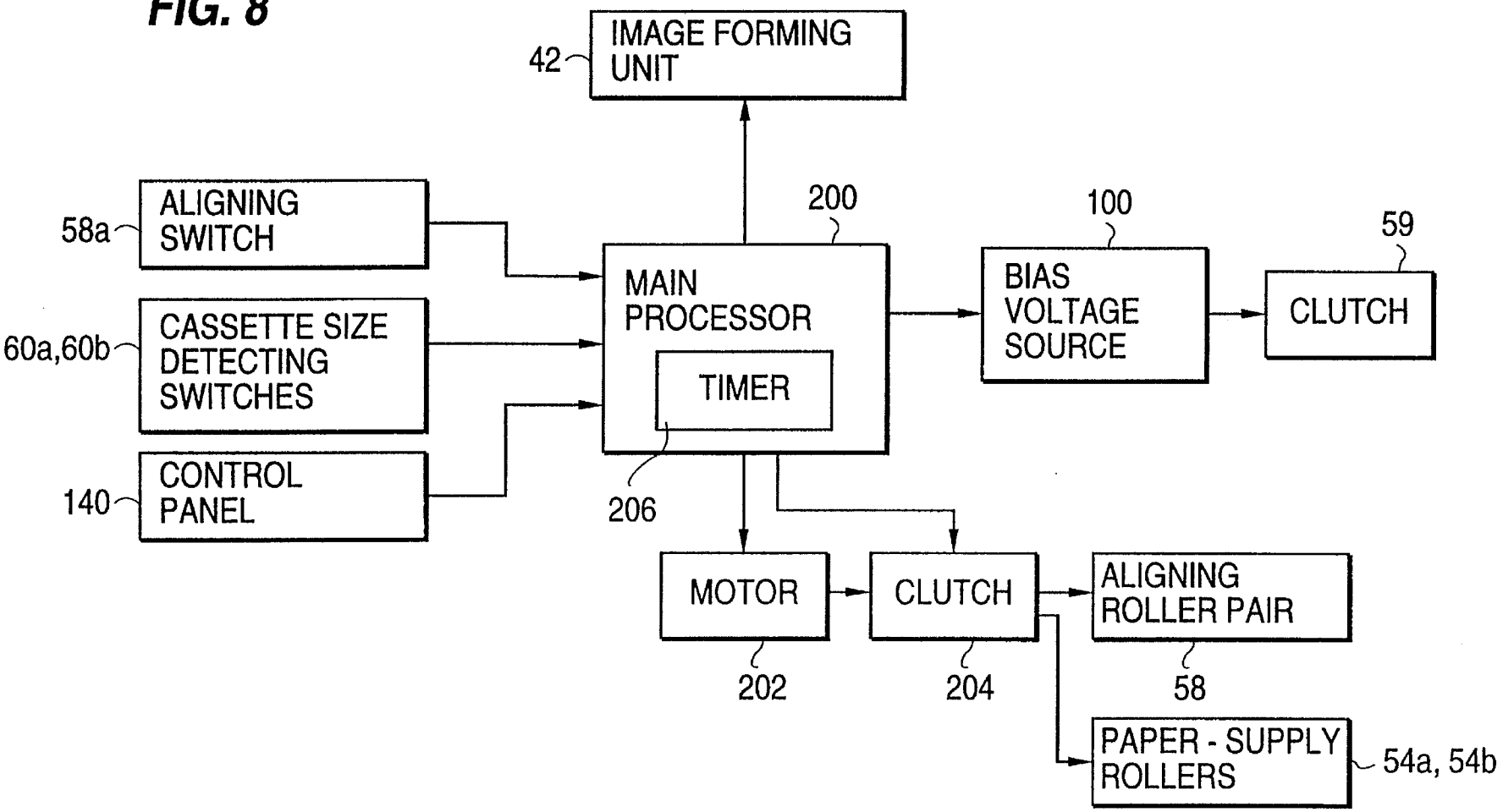
FIG. 8 is a block diagram showing an arrangement of a control system of the copying machine.

As shown in FIG. 8, the control system has a main processor 200. Main processor 200 receives the detection signal from aligning switch 58*a*, cassette size detecting switches 60*a* and 60*b*, and a signal from a control panel 140. Main processor 200 controls image-forming unit 42, bias voltage source 100 connected to guide 59, a motor 202 for driving a plurality of elements including paper-supply roller 54*a* and 54*b* and aligning roller pair 58, and a clutch 204 for intermittently transmitting the driving force from motor 202. Also, main processor 200 includes a timer 206.

Figure 9:
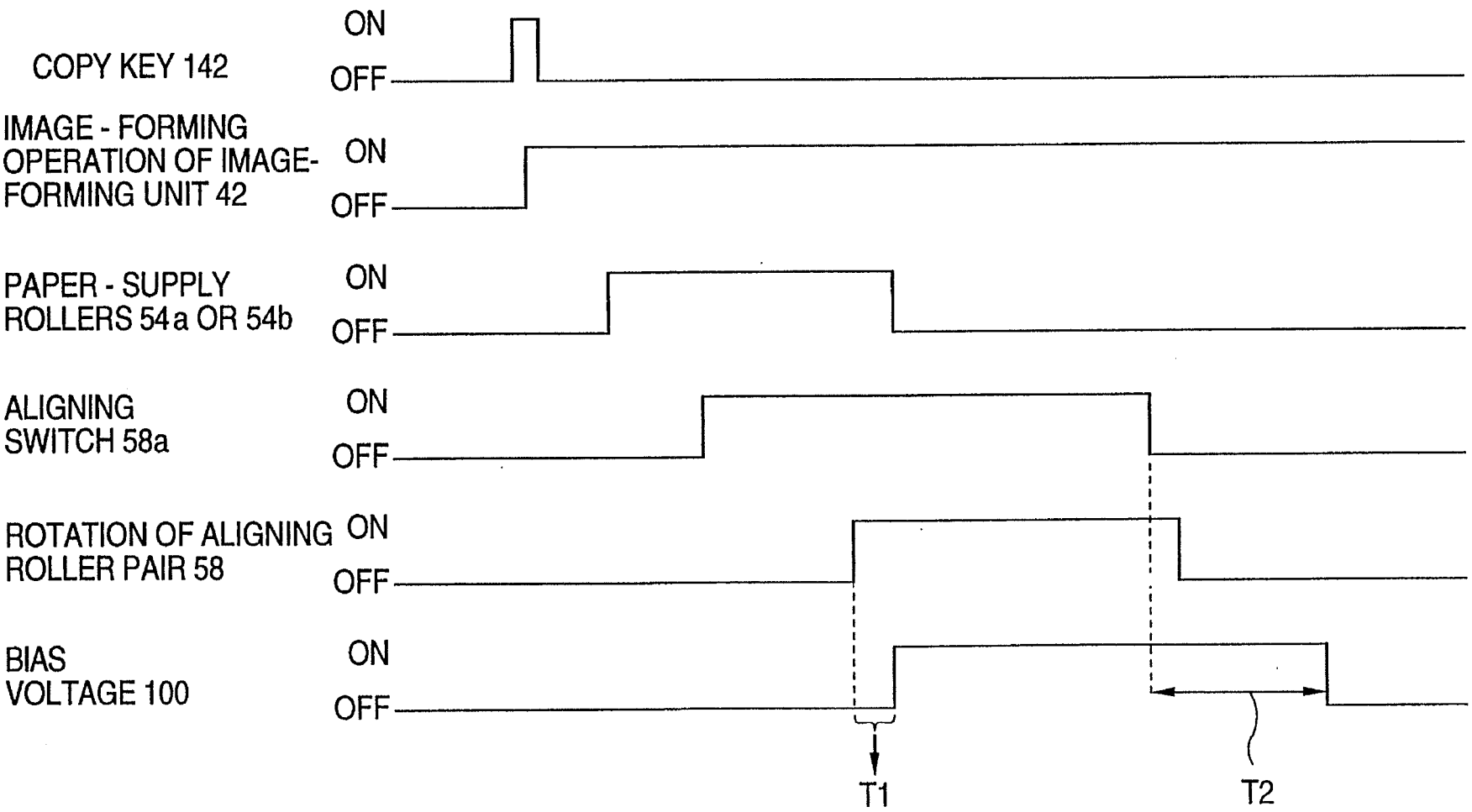
FIG. 9 is a timing chart explaining the operation of the control system.

A controlling operation of this controlling system will now be described in reference to FIGS. 9 and 10.

When copy key 142 on control panel 140 is depressed by an operator, main processor 200 makes image-forming unit 42 start the image-forming operation. Before depressing of copy key 142, one of upper paper cassette 52*a* and lower paper cassette 52*b* may be selected by the operator using control panel 140, and main processor 200 makes one of paper-supply rollers 54*a* and 54*b* pick up paper sheet P corresponding to the selection. If the selection has not been done, main processor 200 automatically determines that upper paper cassette 52*a* has been selected.

Main processor 200 drives motor 202 so as to rotate one of paper-supply rollers 54*a* and 54*b*. Paper sheet P picked up by the paper-supply rollers is led to aligning roller pair 58 which is not rotating. When aligning switch 58*a* detects paper sheet P, timer 206 starts to operate in order to detect that a predetermined time period (0.2 sec.) elapses. This predetermined time period is a period for which aligning roller 58 aligns the leading edge of paper sheet P.

When the predetermined time period has elapsed, main processor 200 engages clutch 204 so that aligning roller pair 58 rotates. When timer 206 detects that a time period T1 elapses after starting of rotation of aligning roller pair 58, main processor 200 energizes bias voltage source 100 so as to apply the bias voltage to some of the conductive guide members 59*b* to 59*l* of guide 59 in accordance with the size of paper sheet P. Main processor 200 determines the size of paper sheet P on the basis of the output signal from cassette size detecting switches 60*a* and 60*b*. For example, if the size is "A4-width", then main processor 200 turns on switches 106*a*, 106*b*, and 106*c* so as to apply the bias voltage to conductive guide members 59*b*, 59*c*, 59*d*, 59*e*, and 59*f*. This is because a paper sheet designated A4-width as shown in FIG. 4, contacts conductive guide members 59*b*, 59*c*, 59*d*, 59*e*, and 59*f* when it is transported. Similarly, if the size is the "B4-length", the main processor 200 turns on switches 106*a*, 106*b*, 106*c*, and 106*d* so as to apply the bias voltage to conductive guide members 59*b*, 59*c*, 59*d*, 59*e*, 59*f*, 59*g*, and 59*h*.

Figure 10:
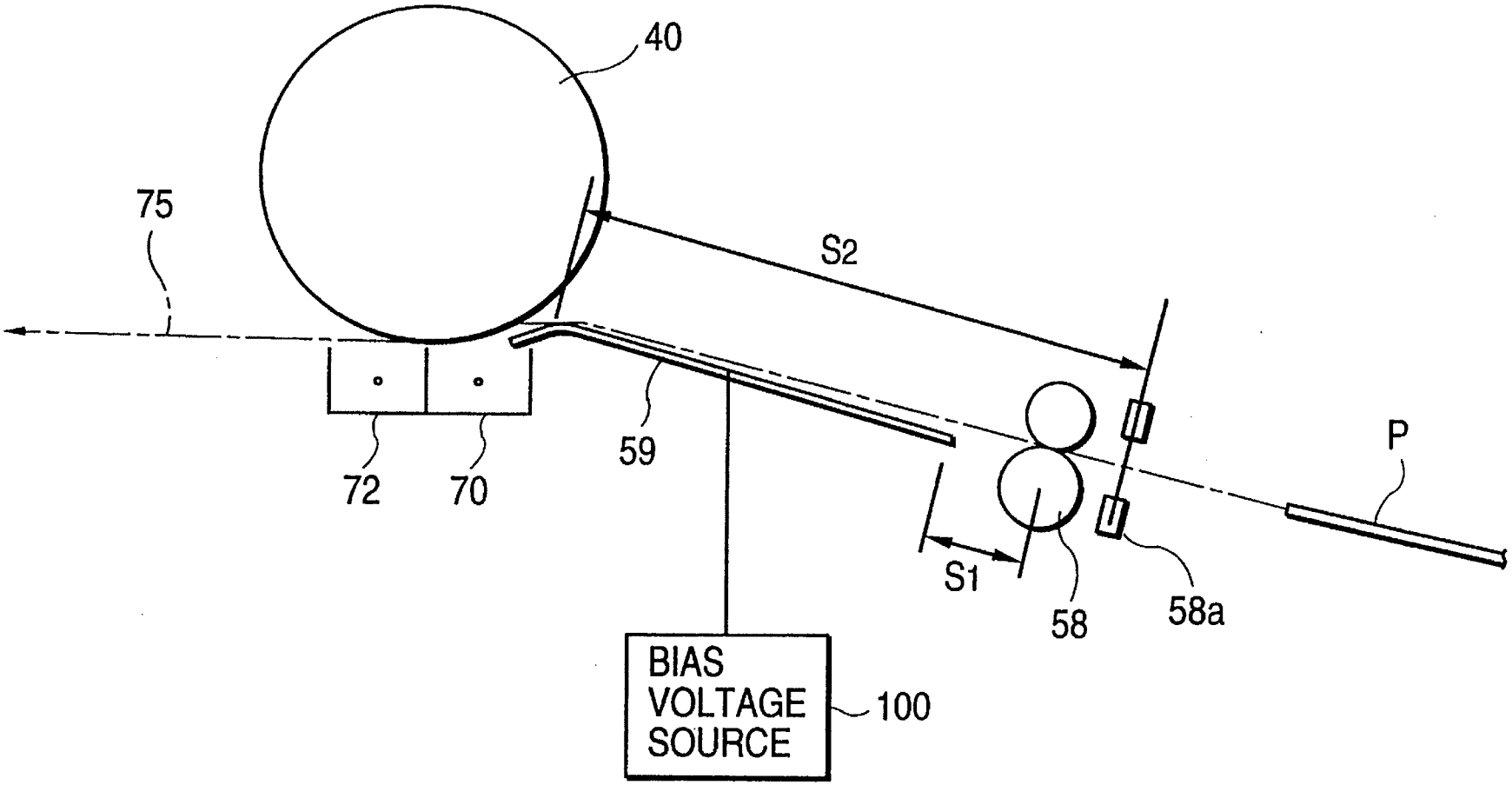
FIG. 10 is an enlarged view of a portion of the sectional view of FIG. 1 for use in better understanding the timing chart of FIG. 9.

In the meantime, time period T1 is a period for which aligning roller pair 58 transports the leading edge of the paper sheet from aligning roller pair 58 to the closest edge of guide 59, as shown as S1 in FIG. 10. Thus, time period T1 is calculated according to an equation "S1+V", wherein V represents the transport speed of the paper sheet.

Main processor 200 disengages clutch 204 so that aligning roller pair 58 stops rotating after the trailing edge of the paper sheet has passed aligning roller pair 58. Main processor 200 determines that the trailing edge has passed it when a predetermined time period has elapsed after turning off of aligning switch 58*a*. When timer 206 detects that a time period T2 elapses after the rotation of aligning roller pair 58 has stopped, main processor 200 disenergizes bias voltage source 100 so as not to apply the bias voltage to any of the conductive guide members. Time period T2 is a period for which the trailing edge of the paper sheet has passed guide 59 after aligning switch 58*a* has turned off, as shown as S2 in FIG. 10. Thus, time period T2 is calculated according to an equation "S2+V", wherein V represents the transport speed of the paper sheet.

In this way, the bias voltage is applied to only the conductive guide member with which the paper sheet contacts when the paper sheet is transported, and only when the paper sheet contacts with the conductive guide member.

Figure 11:
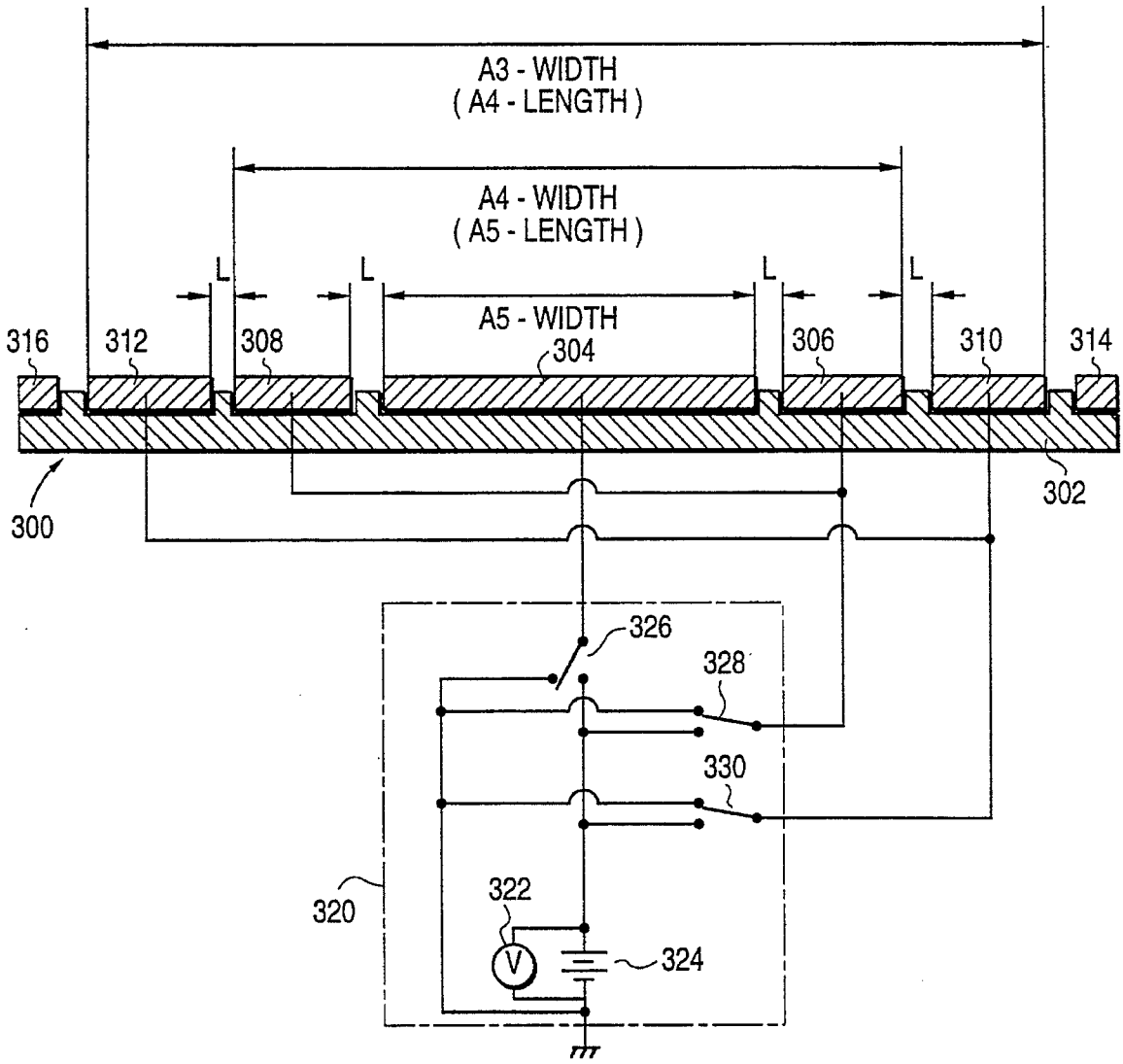
FIG. 11 is a sectional view of a guide of a second embodiment.

FIG. 11 shows a second embodiment of the guide arranged upstream of the transfer region, and the bias voltage source. In this embodiment, the guide and the bias voltage source are for a copying machine which handles only A-type paper.

A guide 300 has a base member 302 made from an insulating material, and conductive guide members 304, 306, 308, 310, 312, 314, and 316. Conductive guide members 304, 306, 308, 310, and 312 are coupled to bias voltage source 320. Conductive guide members 304, 306, 308, 310, 312, 314, and 316 are arranged on base member 302 and elongated along the transport direction of a paper sheet P. Also, conductive guide members 304, 306, 308, 310, 312, 314, and 316 are formed integrally with base member 302. Conductive guide member 304 is arranged on the central portion of guide 300, and the width of conductive guide member 304 corresponds to the width of A5. Conductive guide members 306 and 308 are arranged on the outside of conductive guide member 304 so that there is the distance L. The distance between the outer edge of conductive guide member 306 and the outer edge of conductive guide member 308 corresponds to the width of A4 (A5-length). The distance between the outer edge of conductive guide member 310 and the outer edge of conductive guide member 312 corresponds to the width of A3 (A4-length).

Bias voltage source 320 includes an oscillatory voltage source which has an AC voltage source 322 and a DC voltage source 324, and switches 326, 328, and 330. The peak-to-peak voltage of AC voltage source 322 is preferably about 1 KV to 2 KV, and the DC voltage of DC voltage source 324 is preferably about 1 KV to 2 kV.

Each switch 326, 328, and 330 alternatively connects the oscillatory voltage source and a ground potential to the corresponding conductive guide member. Conductive guide member 304 couples to switch 326. Conductive guide members 306 and 308 couple to switch 328. Conductive guide members 310 and 312 couple to switch 330. The timing at which the control system turns on each switch 326, 328, and 330 depends on the timing of the paper sheet transportation and the size of the paper sheet as discussed in connection with the first embodiment.

The present invention may be embodied in other specific forms without departing form the spirit or essential characteristics thereof. The present embodiment is therefore to be considered in all respects as illustrative and not restrictive, the scope of the present invention being indicated by the appended claims rather than by the foregoing description and all changes which come within the meaning and range of equivalency of the claims are therefore intended to be embraced therein.

What is claimed is:

1. A transport device for alternatively transporting a first sheet-like material which is a first size and a second sheet-like material which is a second size different than the first size, to pass a charging portion which applies an electric charge of a predetermined polarity, comprising:

a base member made from an insulating material;

a first conductive guide member arranged on the base member along a transport direction of the first sheet-like material and the second sheet-like material, the first conductive guide member guiding both the first sheet-like material and the second sheet-like material;

a second conductive guide member arranged on the base member along the transport direction and apart from the first conductive guide member, the second conductive guide member guiding the second sheet-like material;

a voltage source coupled to the first conductive guide member and the second conductive guide member, a polarity of voltage applied by the voltage source being approximately the same as the predetermined polarity;

a first switch arranged between the voltage source and the first conductive guide member;

a second switch arranged between the voltage source and the second conductive guide member; and a control device for turning on the first switch when the first sheet-like material is guided, and for turning on the first switch and the second switch when the second sheet-like material is guided.

2. A transport device according to claim 1, wherein the base member includes a projection formed between the first conductive guide member and the second conductive guide member.

3. A transport device according to claim 2, wherein the first conductive guide member includes a first guide surface which contacts the first sheet-like material and the second sheet-like material, the second conductive guide member includes a second guide surface which contacts with the second sheet-like material, and the projection includes a projecting surface which is lower than the first guide surface and the second guide surface so as not to contact the first sheet-like material and the second sheet-like material.

4. A transport device according to claim 3, wherein a distance between the first conductive guide member and the second conductive guide member is about 0.5 mm to 10.0 mm, and a gap between the first and second guide surfaces and the projecting surface is about 1 mm or more.

5. An image-forming apparatus for forming an image on a sheet-like material, comprising:

means for forming a toner image on an image-bearing member;

means for electrostatically transferring the toner image from the image-bearing member to a sheet-like material by applying an electric charge of a predetermined polarity to the sheet-like material at a transfer region;

means for transporting the sheet-like material so as to pass the transfer region, the transporting means having a conductive guide member which contacts the sheet-like material when the transferring means transfers the toner image; and means for applying a bias voltage to a predetermined area of the conductive guide member, a polarity of the bias voltage being approximately the same as the predetermined polarity, the predetermined area being an area which contacts the sheet-like material when the transporting means transports the sheet-like material and corresponds to a size of the sheet-like material.

6. An image-forming apparatus according to claim 5, wherein the applying means includes means for detecting that the sheet-like material is guided by the conductive guide member, and means for switching the bias voltage so as to apply it when the sheet-like material is guided by the conductive guide member and so as not to apply it when the sheet-like material is not guided by the conductive guide.

7. An image-forming apparatus according to claim 5, wherein the transporting means includes means for alternatively providing one of a first sheet-like material and a second sheet-like material, the first sheet-like material being a first size and the second sheet-like material being a second size different than the first size.

8. An image-forming apparatus according to claim 7, wherein the transporting means includes a base member for supporting the conductive guide member, and the conductive guide member includes a first conductive guide member and a second conductive guide member, the first conductive guide member being arranged on the base member along a transport direction of the first sheet-like material and the second sheet-like material, the first conductive guide member guiding both the first sheet-like material and the second sheet-like material, and the second conductive guide member being arranged on the base member along the transport direction and apart from the first conductive guide member, the second conductive guide member guiding the second sheet-like material.

9. An image-forming apparatus according to claim 8, wherein the applying means includes a first switch and a second switch, the first switch being between the bias voltage and the first conductive guide member so as to turn on when the first sheet-like material and the second sheet-like material are guided, the second switch being between the bias voltage and the second conductive guide member so as to turn on when the second sheet-like material is guided.

10. An image-forming apparatus according to claim 9, wherein the base member includes a projection formed between the first conductive guide member and the second conductive guide member.

11. An image-forming apparatus according to claim 10, wherein the first conductive guide member includes a first guide surface which contacts the first sheet-like material and the second sheet-like material, the second conductive guide member includes a second guide surface which contacts with the second sheet-like material, and the projection includes a projecting surface which is lower than the first guide surface and the second guide surface so as not to contact the first sheet-like material and the second sheet-like material.

12. An image-forming apparatus according to claim 11, wherein a distance between the first conductive guide member and the second conductive guide member is about 0.5 mm to 10.0 mm, and a gap between the first and second guide surfaces and the projecting surface is about 1 mm or more.

13. An image-forming method for forming an image on a sheet-like material, comprising the steps of:

forming a toner image on an image-bearing member;

electrostatically transferring the toner image from the image-bearing member to a sheet-like material by applying an electric charge of a predetermined polarity to the sheet-like material at a transfer region;

transporting the sheet-like material to the transfer region using a conductive guide member when the transferring means transfers the toner image; and applying a bias voltage to a predetermined area of the conductive guide member, a polarity of the bias voltage being approximately the same as the predetermined polarity, the predetermined area being an area which contacts the sheet-like material when the sheet-like material is transported and corresponds to a size of the sheet-like material.

* * * * *